US006135337A

United States Patent [19]

Harris et al.

[11] Patent Number: 6,135,337

[45] Date of Patent: Oct. 24, 2000

[54] ELECTRIC STAPLER

[75] Inventors: James M. Harris; Gerald P. Fregeolle, both of Statesville, N.C.; Jeffrey A. Karg, Hopkinton, Mass.; David F. Tyndell, Seneca, S.C.

[73] Assignee: Hunt Holdings, Inc., Wilmington, Del.

[21] Appl. No.: 09/232,111

[22] Filed: Jan. 15, 1999

[51] Int. Cl.[7] ..... B27F 07/00

[52] U.S. Cl. ..... 227/131; 227/5; 227/7

[58] Field of Search ..... 227/131, 7, 129, 227/133, 147, 132, 6, 5, 2

[56] References Cited

U.S. PATENT DOCUMENTS

| | | | |
|---|---|---|---|
| 2,770,805 | 11/1956 | Elzer et al. | 227/7 |
| 3,278,101 | 10/1966 | Hatazaki | 227/7 |
| 3,423,002 | 1/1969 | Hatazaki et al. | 227/131 |
| 3,625,408 | 12/1971 | Moriguchishi et al. | 227/131 |
| 3,666,157 | 5/1972 | Kawal et al. | 227/131 |
| 3,766,455 | 10/1973 | Zakrewsky et al. | 227/131 |
| 4,199,095 | 4/1980 | Yamonoi | 227/129 |
| 4,491,260 | 1/1985 | Jimena | 227/7 |
| 4,508,329 | 4/1985 | Hubler et al. | 227/2 |
| 4,558,391 | 12/1985 | Ward et al. | 227/131 |
| 4,720,033 | 1/1988 | Olesen | 227/131 |
| 4,726,505 | 2/1988 | Okazaki | 227/132 |
| 4,811,885 | 3/1989 | Lai | 227/131 |
| 5,007,572 | 4/1991 | Chung-Cheng | 227/7 |
| 5,009,355 | 4/1991 | Akizawa et al. | 227/131 |
| 5,012,967 | 5/1991 | Johansson | 227/7 |
| 5,195,671 | 3/1993 | Shimomura et al. | 227/7 |
| 5,222,645 | 6/1993 | Sueda | 227/7 |
| 5,282,564 | 2/1994 | Rio | 227/132 |
| 5,330,086 | 7/1994 | Shimomura et al. | 227/7 |
| 5,335,838 | 8/1994 | Harris et al. | 227/132 |
| 5,413,266 | 5/1995 | Jairam | 227/129 |
| 5,460,314 | 10/1995 | Udagawa | 227/131 |
| 5,529,234 | 6/1996 | Juneau | 227/147 |
| 5,803,337 | 9/1998 | Fukai et al. | 227/131 |

FOREIGN PATENT DOCUMENTS

| | | |
|---|---|---|
| 0 322 906 | 12/1988 | European Pat. Off. . |
| 0 530 855 | 12/1988 | European Pat. Off. . |
| 0 530 857 | 12/1988 | European Pat. Off. . |
| 0 579 118 | 7/1993 | European Pat. Off. . |
| 0 605 888 | 12/1993 | European Pat. Off. . |
| 0 612 594 | 2/1994 | European Pat. Off. . |
| WO 93/19898 | 10/1993 | WIPO . |
| WO 93/20980 | 10/1993 | WIPO . |
| WO 94/00277 | 1/1994 | WIPO . |
| WO 94/27788 | 12/1994 | WIPO . |

OTHER PUBLICATIONS

Catalog pages entitled Rapid 65 Electric The silent stapler (2 pages) by Rapid, identified on page 2 as 10,000 Eng. 93. 11. No. 11 (dated Nov. 1993).

Catalog pages entitled EF Rapid 90 Electric Power Stapler (2 pages) Nov. 1993 by Eberhard Faber.

Catalog page entitled EF Rapid 100E Electric Power Stapler (2 pages) Sep. 1993 by Eberhard Faber.

Catalog pages entitled Rapid 65 Electric The silent stapler (2 pages) by Rapid Nov. 1993.

*Primary Examiner*—Peter Vo
*Assistant Examiner*—Jim Calve
*Attorney, Agent, or Firm*—Synnestvedt & Lechner LLP

[57] ABSTRACT

An electrically powered stapler is disclosed having a sliding blade for driving staples which is reciprocated by a lever and crank mechanism driven by an electric motor through a torque increasing gear train. Jamming of the stapler is prevented by mounting the lever's fulcrum on a plunger which is releasably retained to a fixed support by a flexible collar. The plunger has an enlarged head, and the collar has a plurality of flexible fingers which grip the plunger behind the head to retain the plunger to the collar. The plunger can be disengaged from the collar by the application of a predetermined force directed away from the plunger, such as occurs on the fulcrum during a jammed condition when the blade cannot drive a staple and is stalled. The pivot point of the lever then shifts to the blade end of the lever and the plunger is reciprocated by the lever instead of the blade, allowing the motor and other components to cycle through their full range of motion without stalling. The plunger is reengaged into the collar automatically as the plunger is reciprocated and the stapler is again ready to staple.

21 Claims, 8 Drawing Sheets

20
22
34
36
38
40
42
44
48
50
46
54
52
56
58
60
62
2
2A
11
12
120
122
80
70
78
76
74
88
86
98
82
72
68
94
92
92a
92b
68b
66a
90
64
66
68a
84
24
30
32a
32b
28
26
27

ELECTRIC STAPLER

FIELD OF THE INVENTION

This invention relates to electric staplers for attaching sheet material, such as paper and the like, together and especially to staplers having a mechanism for preventing jamming during operation.

BACKGROUND OF THE INVENTION

Staplers using wire staples for attaching, for example, sheets of paper together are a necessary tool in the modern office. Manually operated staplers are in widespread use largely due to their modest price and outstanding reliability.

However, some force is required to operate a manual stapler, especially when driving a staple through a thick stack of paper. To use a manual stapler, it must first be conveniently positioned on a table or desk so that the user can orient his hand and arm to exert sufficient force to drive the staple. Alternatively, the stapler can be grasped in the hand and squeezed between the fingers and palm to drive the staple. Either way requires that the stapler itself be repeatedly handled and/or moved, creating unnecessary and time-consuming operations.

Electrically powered staplers eliminate the aforementioned disadvantages associated with manual staplers in that the electric stapler need not be handled by the user. It can be located in any convenient location on a desk or table, far enough away from the user so as not to clutter his or her workspace and yet within easy reach to allow the user to extend a stack of paper into the stapler to effect attachment of the sheets in the stack.

Such electrical staplers are not without their problems, however, the most serious of which is their propensity to jam when overburdened with too many sheets in a stack. The jams tend to be difficult to clear, and the paper is often caught in the stapler and mangled by attempts to release it. There is clearly a need for an electric stapler which will not jam when overburdened and yet will continue to operate immediately after being overburdened by attempting to staple too thick a stack of paper together.

SUMMARY AND OBJECTS OF THE INVENTION

This invention provides a stapler using wire staples for stapling sheet material, for example paper. In a preferred embodiment the stapler comprises a magazine for holding the staples, the magazine having a dispensing opening to allow the staples to be stripped from the magazine one at a time. The staples are stripped from the magazine by a blade which is slidably mounted for reciprocal motion with respect to the magazine.

The blade is oriented substantially perpendicularly to the dispensing opening and reciprocates through a forward and a reverse stroke. The blade is interengagable on the forward stroke with a staple disposed at the dispensing opening for stripping the staple from the magazine during reciprocal motion.

An anvil is positioned with respect to the dispensing opening to clinch the staple stripped from the magazine. Clinching is effected by the blade forcing the staple against the anvil during the forward stroke of the blade.

Reciprocal motion of the blade is effected by a lever and an actuator. The blade is pivotally attached to the lever at a first attachment point on the lever. The lever has a fulcrum which is pivotally attached to the lever at a second attachment point spaced from the first attachment point. The actuator for imparting rocking motion to the lever, is pivotally attached to the lever at a third attachment point displaced from the first and second attachment points. Although many arrangements of the attachment points are possible and practical, preferably the second attachment point is located between the first and the third attachment points.

The fulcrum is supported on a fixed support. The fulcrum translates the rocking motion of the lever to reciprocal motion of the blade when it is positioned on this support. However, the lever is free to pivot about the first attachment point when the fulcrum is separated from the support. A flexible retainer is provided for maintaining the fulcrum on the support. The retainer is yieldable however to allow separation of the fulcrum from the support in response to forces preventing blade movement through the forward stroke, such as would occur during a jammed condition when too thick a stack of paper is stapled.

In the preferred embodiment the fulcrum comprises an elongated plunger having first and second ends, the first end being pivotally connected to the lever and the second end having an enlarged head mounted thereon.

The flexible retainer preferably comprises a plurality of fingers mounted on the fixed support. The fingers are positioned about a common center to accept the plunger in mating interengagement, the fingers interengaging the plunger behind the enlarged head when the plunger is in mating interengagement. The fingers retain the plunger to the fixed support, but the fingers are relatively flexible and bend to pass over the enlarged head to allow separation of the plunger from the support in response to the forces which prevent blade movement through its forward stroke.

A second fixed support interengagable with the blade is also provided in the preferred embodiment for preventing blade movement through the reverse stroke when the fulcrum is separated from its fixed support. When the fulcrum is separated from its support the first attachment point forms a second fulcrum for the lever. The actuator pivots the lever about this second fulcrum to again engage the original fulcrum with its fixed support after the original fulcrum is first separated therefrom, in effect resetting the stapler for normal stapling operation after a jammed condition.

Preferably the actuator comprises an elongated slot formed lengthwise along the lever at the third attachment point. A crank, rotatably mounted with respect to said lever, has an eccentric arm extending to interengage the slot. The crank arm pivots the lever about the fulcrum when the crank rotates. Preferably an electric motor is used to rotate the crank and thereby impart the rocking motion to the lever and reciprocate the blade.

A switch assembly is provided for controlling the actuator. Preferably the switch assembly comprises a switch for supplying electrical power to the motor when the switch is in a closed state, the switch normally being in an open state. A first cam is rotatably mounted with respect to and interengagable with the switch. The first cam is moveable to a position in which the switch is closed upon interengagement with the first cam.

The first cam is rotated by a movable pusher. The pusher has an end portion interengagable with the first cam. The pusher is also interengagable with the sheet material and is disposed between the anvil and the magazine. Means for biasing the pusher end portion away from said first cam is provided, preferably in the form of a spring. The pusher rotates the first cam into the position in which the switch is closed upon interengagement of the pusher with the sheet material when the sheet material is inserted between the magazine and anvil for stapling.

A second cam, also rotatably mounted with respect to the switch, is provided as part of the switch assembly. The second cam is rotated by the electric motor upon closure of the switch. The second cam is interengagable with the switch upon rotation to maintain the switch in the closed position. The second cam is also interengagable with the first cam to rotate the first cam out of interengagement with the switch and reposition the first cam adjacent to the pusher end portion, resetting that cam in preparation for the next stapling operation.

Preferably the second cam is mounted coaxially with the crank for rotation about a common axis. The second second cam is disposed diametrically opposite to the crank arm relative to the common axis and has a curved cam surface for engaging the switch. Preferably the cam surface subtends an angle of approximately 180 degrees, thus maintaining the switch in the closed position for a period of time corresponding to half of a full rotation of the second cam.

Rotation of the second cam and the crank is controlled in part by an electrical circuit connecting the motor and the switch with the power source. The motor has first and second motor terminals for connecting into the circuit. The switch is preferably a single pole two throw switch and has a common terminal and first and second contacts. The common terminal is alternately connectable to each of the contacts. The switch is defined to be in the closed state when the common terminal is connected to the second contact, and in the open state when the common terminal is connected to the first contact. The circuit further includes first and second power terminals which are energizable at different electrical potentials by a power supply such as a battery. The circuit is formed by a first conductive path which connects the first motor terminal to the first power terminal and the first contact of the switch. A second conductive path connects the second motor terminal to the common terminal of the switch. A third conductive path connects the second contact of the switch to the second power terminal.

The motor is powered when the common terminal is connected to the second contact, which occurs when the first cam is rotated to engage and close the switch. Closing the switch in this manner creates a closed circuit allowing current to flow from the power source to the motor. The motor rotates the second cam which engages the switch to maintain it in the closed position while also engaging the first cam and rotating it out of contact with the switch. When the second cam comes off of the switch the common terminal is again connected to the first contact which interrupts the current from the power source to the motor. Connecting the common terminal to the first contact also connects the first motor terminal to the second motor terminal which allows any transient magnetic fields in the motor to collapse quickly and not provide any significant torque which would turn the motor further than desired.

Preferably the switch has means for biasing the common terminal into contact with the first contact, the common terminal being normally biased into contact thereto.

By releasably attaching the fulcrum to the fixed support a mechanism is formed which prevents the stapler from jamming when overloaded with sheet material which the staple cannot penetrate when it is driven towards the anvil by the forward stroke of the blade.

The arrangement of the lever and fulcrum detailed above is intended to prevent jamming and can be described as a floating pivot point mechanism. This mechanism generally comprises a driven member movably mounted for reciprocal motion, the driven member being pivotally attached to the lever at a first attachment point. A first support is fixed relatively to the lever and the fulcrum is releasably mounted thereon, the fulcrum being pivotally attached to the lever at a second attachment point spaced from the first attachment point.

A driving assembly for pivoting the lever about the fulcrum and thereby driving the driven member in reciprocal motion is pivotally attached to the lever at a third attachment point spaced from the first and second points. A flexible retainer is provided for releasably maintaining the fulcrum on the first support, the retainer being yieldable to allow separation of the fulcrum from the first support in response to forces preventing movement of the driven member.

Preferably the floating pivot point mechanism also has a means for automatically resetting the mechanism after a jammed condition is prevented. The resetting means comprises second support fixed relatively to the lever. The second support is positioned to interengage the lever at the first attachment point when the fulcrum is separated from the first support. The lever pivots about the first attachment point when moved by the driving assembly. This moves the fulcrum into interengagement with the flexible retainer, which thereafter maintains the fulcrum releasably on the first support.

It is an object of the invention to provide an electrically operated stapler for stapling sheet material.

It is another object of the invention to provide a stapler which will not jam when overloaded with sheet material.

It is still another object of the invention to provide a floating pivot point mechanism useable to prevent a stapler from jamming.

It is yet another object of the invention to provide a stapler which will reset automatically after a jam has been prevented.

It is also another object of the invention to provide a stapler which will readily and reliably operate in multiple succession to staple sheet material.

It is yet a further object of the invention to provide a circuit for wiring the motor powering the stapler which will reliably stop the motor after power has been cut off thereto by providing an electrical path encouraging the rapid collapse of transient magnetic fields within the motor.

These and other objects will become apparent from a consideration of the following drawings and detailed description of preferred embodiments of the invention.

DETAILED DESCRIPTION OF THE PREFERRED EMBODIMENT

Figure 1:
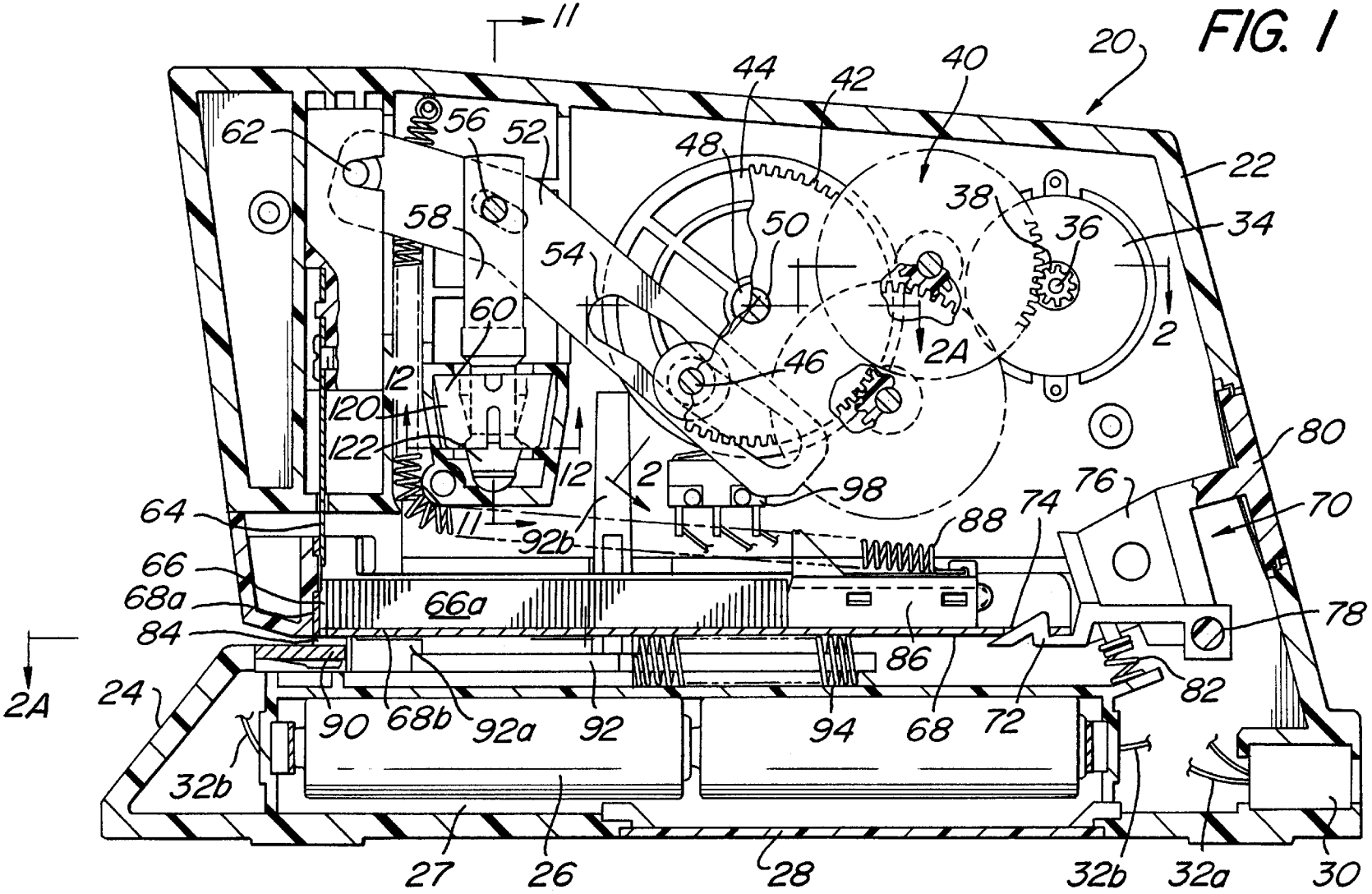
FIG. 1 shows a cross-sectional side view of a stapler according to the invention.

FIG. 1 shows a cross-sectional view of an electric stapler 20 according to the invention. Housing 22 preferably provides a mounting structure for the various internal components, as well as a base 24 for supporting the stapler upright on a surface, such as a desk or table. Base 24 is also used to house batteries 26 to power the stapler, the batteries being supported in a receptacle 27 within the base. Access to the batteries is afforded by a removable door 28. Power can also be supplied from a standard 110V AC wall outlet by a transformer and rectifier (not shown), the base housing an electrical jack 30 for accepting a plug from the transformer. Electrical power from either the transformer or the batteries is supplied over wires 32*a* or 32*b* (respectively) preferably to a direct current motor 34 mounted within housing 22. The motor size is primarily determined by the maximum number of sheets the stapler is intended to staple in normal operation. For example, a motor developing 40 g-cm of torque in normal operation and 305 g-cm when stalled is needed for a stapler handling up to 20 sheets of 75 g/m$^2$ weight paper, whereas a smaller motor would be required for a stapler stapling a maximum of 12 sheets of the same weight paper.

Figure 2:
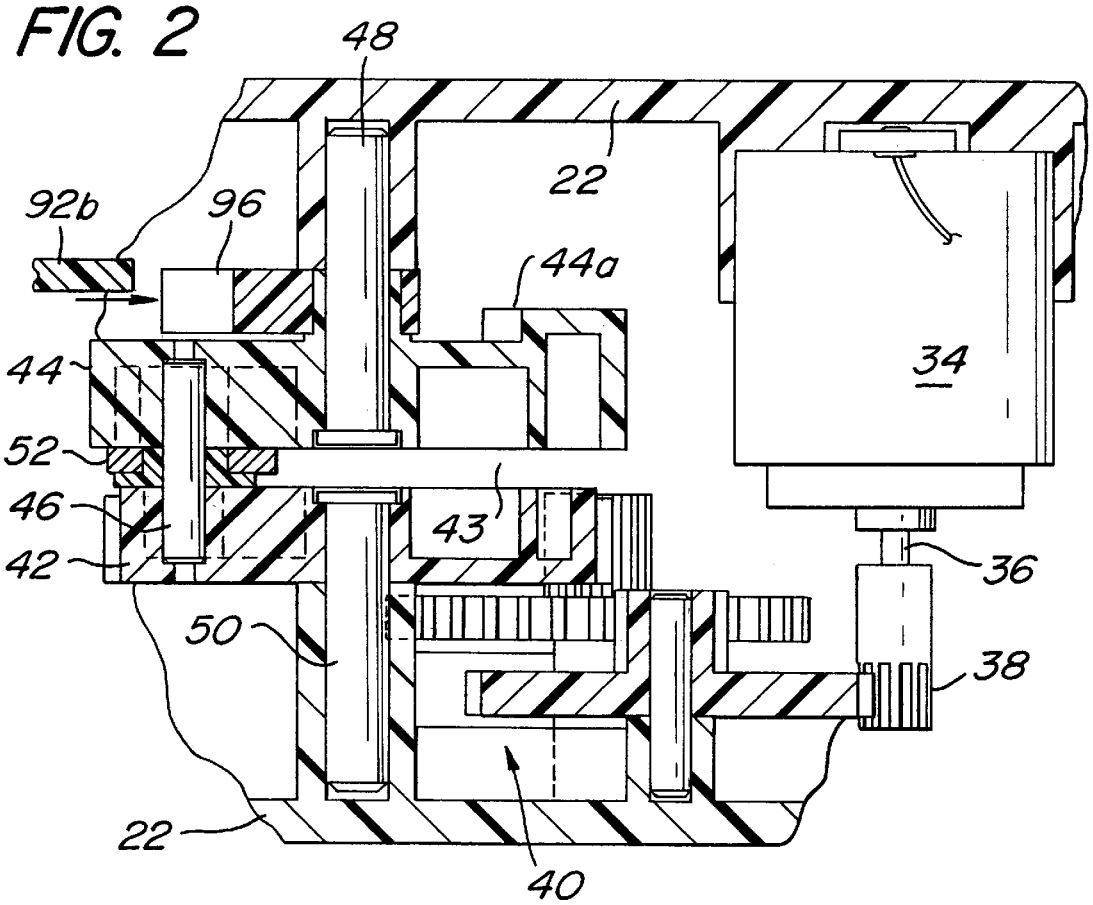
FIG. 2 shows a partial sectional view on an enlarged scale taken along line 2—2 of FIG. 1.

As best seen in FIG. 2, the motor shaft 36 mounts a pinion 38 which drives a torque increasing gear train 40. The final drive gear 42 of gear train 40 is coupled to a cam wheel 44 by means of an eccentrically mounted crank arm 46 extending between gear 42 and wheel 44. Cam wheel 44 is rotatably mounted on an axle 48 extending from one side of housing 22, and final drive gear 42 is rotatably mounted on an axle 50 which extends from the opposite housing side and is coaxially aligned with axle 48. Final drive gear 42 and cam wheel 44 are arranged in a parallel, spaced apart relation creating a gap 43 between them which allows a lever 52 to be engaged by crank arm 46 to effect pivotal or rocking motion of lever 52 upon rotation of gear 42 and cam wheel 44. As seen in FIG. 1, lever 52 has an elongated slot 54 arranged at one end which accepts crank arm 46. Together the motor, gear train, and crank form an actuator and provide a means for rocking the lever about a fulcrum, described below.

Lever 52 is pivotally mounted on a pin 56 which provides a fulcrum for the lever during normal stapler operation. Pin 56 is supported on a plunger 58 which is releasably held in interengagement with a release collar 60, fixedly attached to housing 22. Plunger 58 and release collar 60 provide a means for preventing the stapler from jamming and are described in detail below.

The other end of lever 52 is pivotally mounted via a pin connection 62 to a blade 64. Blade 64 is slidably mounted within housing 22 in a parallel, spaced apart relation with plunger 58. Reciprocal motion of blade 64 within the housing is effected when motor 34, operating through gear train 40 rotates crank arm 46 about axle 50. As crank arm 46 rotates, it traverses slot 54 in lever 52 and converts the rotary motion of the crank arm to rocking motion of the lever. Lever 52, pivoting about the fulcrum at pin 56, slides blade 64 in reciprocal motion within housing 22.

Blade 64 is positioned to interengage a staple 66 which is held, along with a multiplicity of other staples 66*a*, in a magazine 68 which is slidably mounted in the housing. Magazine 68 is retained within the housing by a latch mechanism 70. Latch mechanism 70 comprises a catch 72 which interfits within an aperture 74 in magazine 68 to retain the magazine within the housing. Catch 72 extends from a body portion 76 which is rotatably mounted within the housing on an axle 78. A button 80 extends from the body portion 76 to an exposed position on the outside of housing 22. To release magazine 68 from the housing, button 80 is manually pushed. This rotates body portion 76 about axle 78, disengaging catch 72 from aperture 74. Magazine 68 can then slide outwardly from the housing, thus allowing access to the magazines to reload staples 66*a*. Body portion 76 is spring biased by spring 82 which causes catch 72 to automatically engage aperture 74 when magazine 68 is moved back into contact with the catch.

Magazine 68 has a dispensing opening 84 arranged in relation to blade 64 to allow the blade to move from one side of the opening to the other during reciprocal motion. Dispensing opening 84 preferably takes the form of a slot positioned at the end of magazine 68 and aligned parallel with staples 66*a*. The slot is formed between the end 68*a* and the bottom 68*b* of magazine 68.

Magazine 68 also has a shoe 86 slidable within the magazine and biased towards one end thereof by a spring 88. Shoe 86 engages staples 66*a*, forcing the staples toward the end of the magazine located opposite blade 64 where staple 66 is positioned in alignment between blade 64 and dispensing opening 84. During reciprocal motion, blade 64 engages staple 66 on a forward stroke and strips it from magazine 68, forcing the staple outwardly through the dispensing opening 84. An anvil 90 is positioned in base 24 opposite blade 64. Staple 66 is forced against anvil 90 which clinches the staple, thus, binding any sheet material positioned between the magazine and the anvil. Shoe 86, biased by spring 88, forces the next staple into alignment with the blade 64 and the dispensing opening 84 after the blade clears the staples 66*a* in the reverse stroke portion of its reciprocal movement.

Figure 2A:
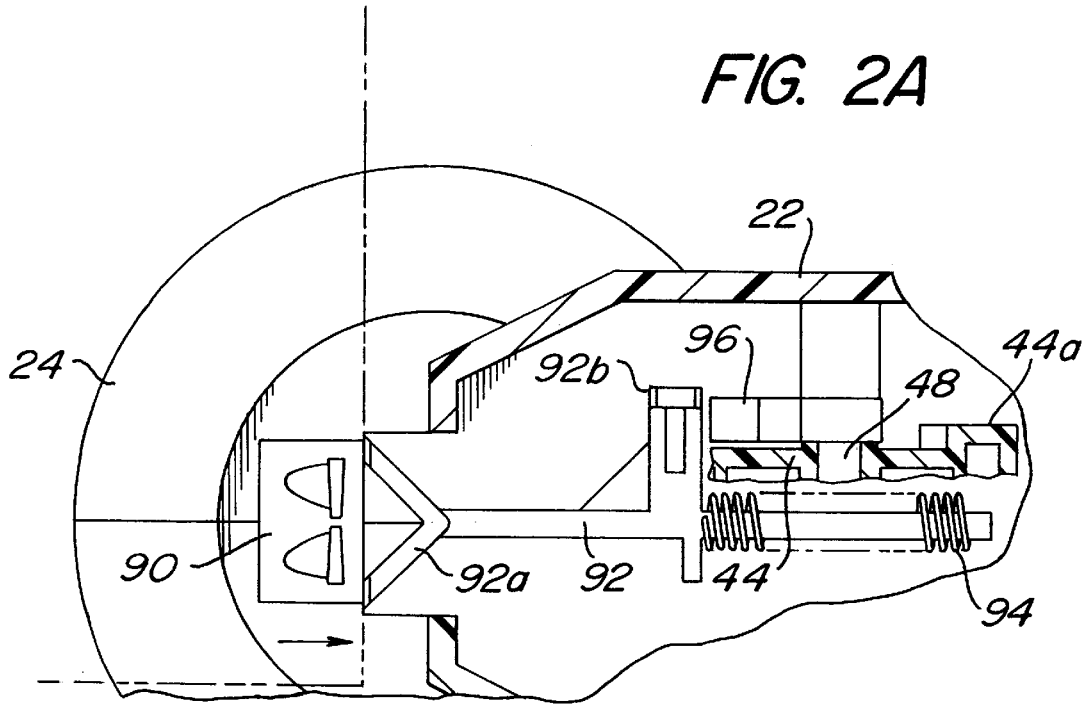
FIG. 2A shows a partial sectional view on an enlarged scale taken along line 2A—2A of FIG. 1.

The stapling function is effected through a pusher 92 located adjacent to magazine 68. As seen in FIG. 2A, pusher 92 has a sheet material engaging portion 92*a*, positioned outside of the housing 22 just behind anvil 90. Sheet material engaging portion 92*a* is preferably "Y" shaped to engage a corner of the sheet so that the staple will be positioned diagonally to the sheet edges. Engaging portion 92*a* can also engage the flat edge of the sheet to place the staple parallel to the sheet material edge.

The pusher also has a cam engaging portion 92*b* which extends from the pusher substantially perpendicularly into housing 22. Pusher 92 is biased toward anvil 90 by a biasing means represented by spring 94. Cam engaging portion 92*b* engages a floating cam 96 (see FIGS. 2–4) to close a switch 98 which controls the power from batteries 26 (or the transformer, not shown) to motor 34. The floating cam 96 is rotatably mounted coaxially with cam wheel 44 on axle 48. Floating cam 96 is arranged adjacent to cam wheel 44 but rotates independently of the cam wheel. The pusher and cam arrangement are described in detail in the stapler operation section below, and provide a means interengagable with the sheet material for actuating the lever rocking means.

DESCRIPTION OF NORMAL STAPLER OPERATION

FIGS. 3–8 illustrate the normal operation of the stapler, i.e., the stapling of sheet material without a jam occurring in the stapler. (The jam condition is described in detail in a separate section presented below.)

Figure 3:
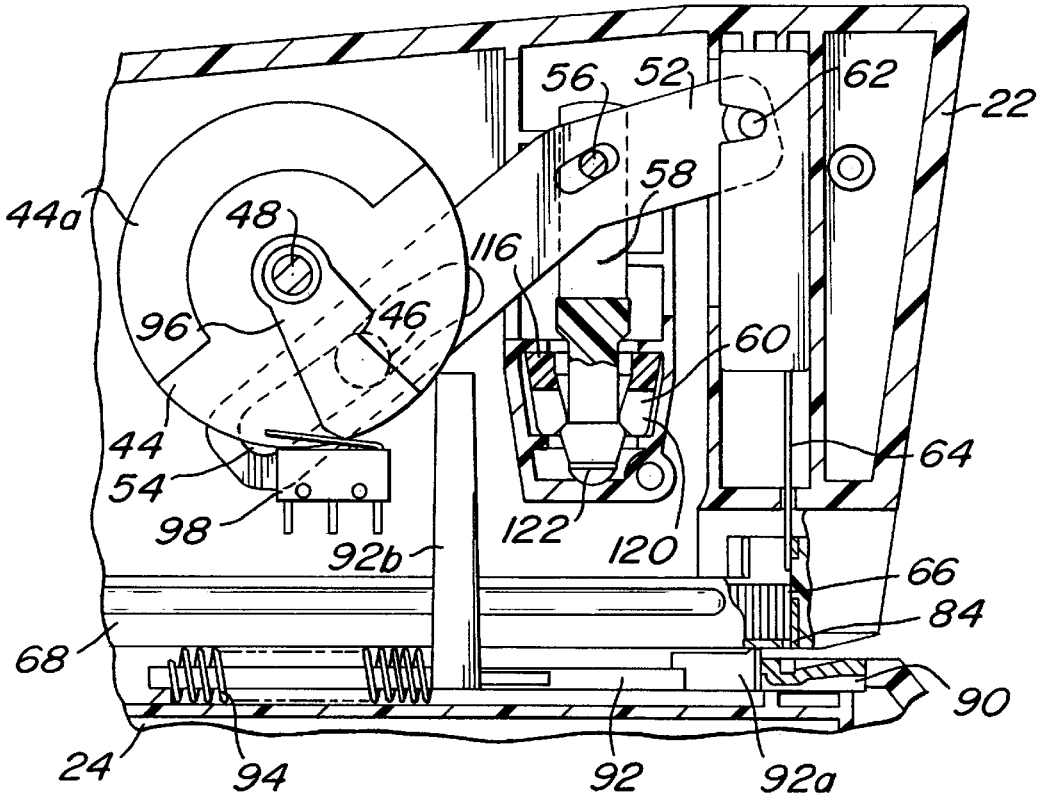
FIGS. 3 and 4 are partial sectional side views on an enlarged scale taken from the side opposite to the side shown in FIG. 1.

FIG. 3 shows a partial sectional view of the stapler with the internal components in the "ready" position. In this state, switch 98 is open thus preventing current from the power source from turning motor 34 (FIG. 1). Blade 64 is at the furthest extent of its reverse stroke (farthest from anvil 90), pusher 92 is biased fully toward anvil 90, plunger 58 is interengaged and held by collar 60, staple 66 is aligned with blade 64 and dispensing aperture 84 and floating cam 96 is resting on switch 98.

Figure 4:
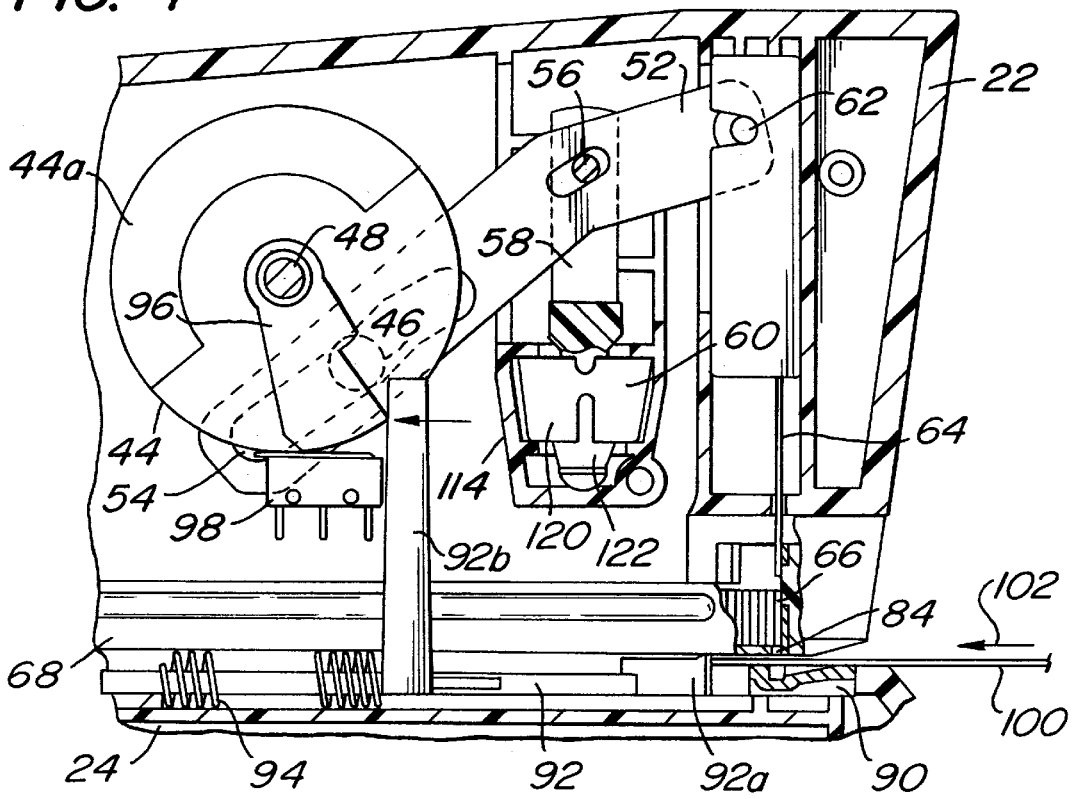

FIG. 4 shows sheet material 100 inserted in the direction of arrow 102 between magazine 68 and anvil 90. Sheet 100 engages sheet material engaging portion 92*a* and slides pusher 92 in the direction of arrow 102 against biasing spring 94. This action forces cam engaging portion 92*b* against floating cam 96, rotating the cam to close the switch 98. Upon the closing of switch 98, power is supplied to motor 34 (FIGS. 1–2) which rotates crank arm 46 and cam wheel 44 by acting through gear train 40.

Figure 5:
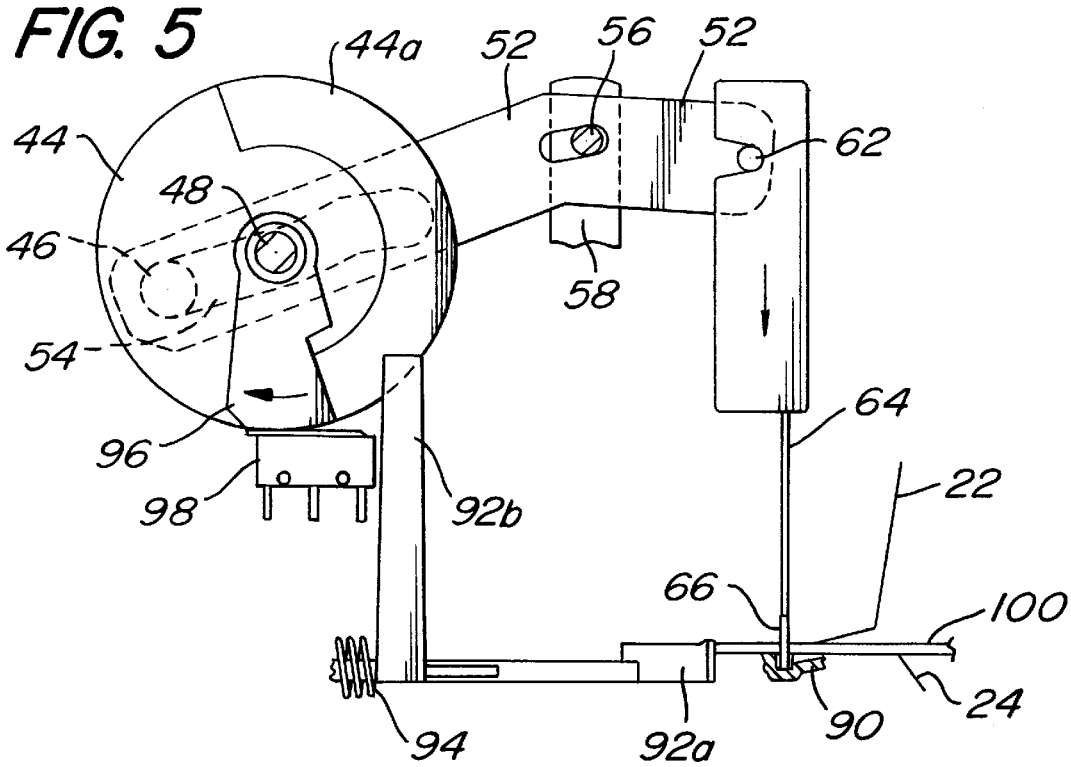
FIGS. 5–8 show a partial view of selected components of FIG. 3 showing different positions of operation.

FIG. 5 shows cam wheel 44 rotated in a clockwise direction. Crank arm 46 has traversed slot 54 in lever 52, converting the rotational motion of the crank into rocking motion of the lever. Lever 52, pivoting about its fulcrum at pin 56 slides blade 64 in its forward stroke toward anvil 90, engaging staple 66 thereby. Staple 66 is stripped from magazine 68 (FIG. 4) and forced through dispensing aperture 84 (FIG. 4) through sheet 100 and against anvil 90 (FIG. 5).

Figure 6:
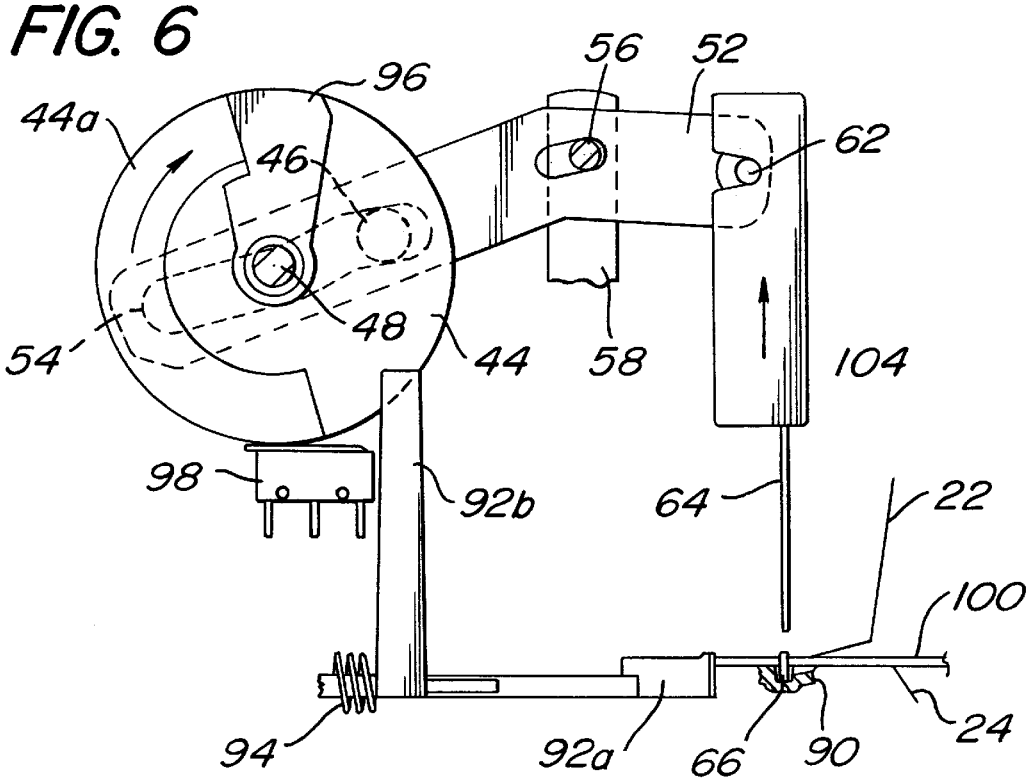

Cam wheel 44 has a cam surface 44*a* (see also FIG. 2) which extends along an arc of the circumference of the cam wheel and outwardly from the side toward the adjacent floating cam. As cam wheel 44 rotates, it brings cam surface 44*a* into contact with floating cam 96 (FIGS. 5–6). As shown in FIG. 6, cam surface 44*a* pushes floating cam 96 off of switch 98 while simultaneously engaging switch 98 to keep it in the closed position so that power is continuously supplied to motor 34. As the cam wheel 44 rotates, crank arm 46 continues to traverse the slot 54 in lever 52. The lever forces blade 64 further toward the anvil thereby clinching staple 66 thereagainst. As cam wheel 44 continues to rotate, it reverses the direction of blade 64, moving it away from the anvil in the direction of its reverse stroke as indicated by arrow 104 and seen in FIG. 6. Cam wheel 44 continues to rotate under the torque from motor 34 as long as cam surface 44*a* maintains switch 98 in the closed state. Eventually, the cam surface falls off the switch which is biased to normally reside in its open position, thereby cutting power to the motor.

FIG. 7 shows switch 98 again in its open position, the cam wheel 44 rotated so that cam surface 44*a* no longer closes the switch. Power to the motor is, thus, cut off but the cam wheel (and, thus, the crank) continues to rotate, carried by its inertia and the inertia of the motor and gear train. Friction eventually halts the motion of the stapler moving parts.

It is desirable to halt the motion of the internal components at the "ready" position shown in FIG. 3 to ensure that the blade 64 is in at the end of its reverse stroke so that it will be capable of its full forward stroke when called upon to staple subsequent sheet material. Unless precautions are taken, however, the motor will continue to provide torque and contribute to undesired motion of the crank despite being cut off from its power supply. This occurs because there is still energy in the motor in the form of transient magnetic fields in the motor windings which continue to produce torque as the fields collapse when the circuit is opened.

Figure 13:
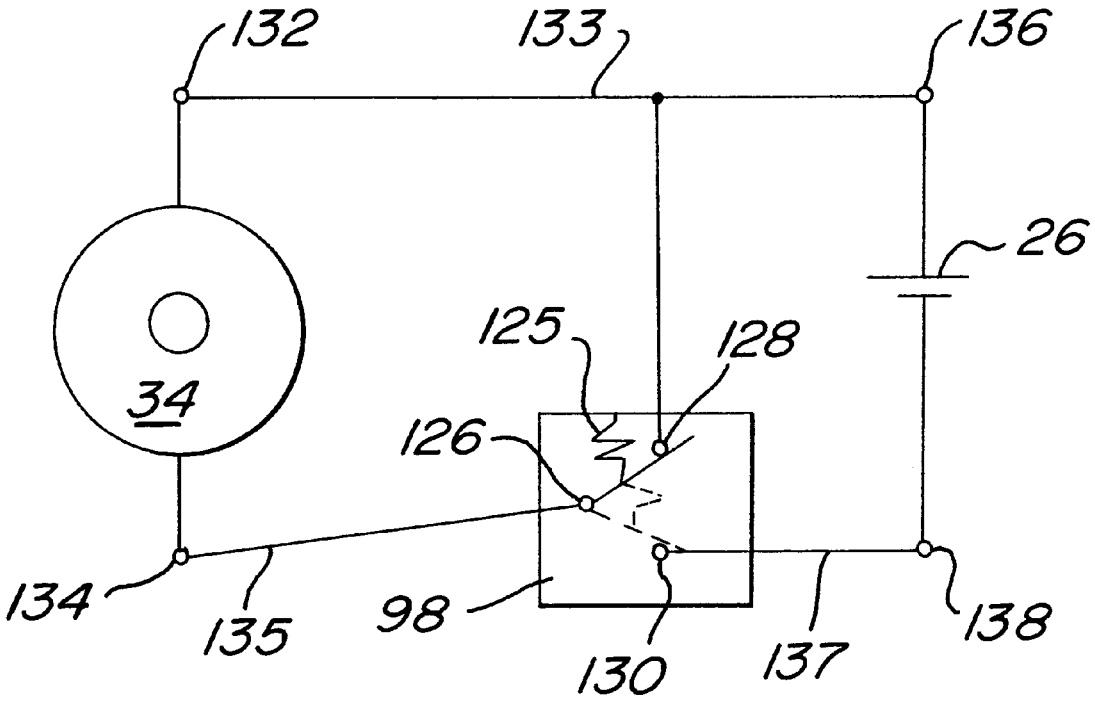
FIG. 13 is a schematic diagram of an electrical circuit used in the stapler.

Preferably, in order to limit the rotation of the crank after the switch is opened and ensure that the blade halts near its desired position, the switch 98 and motor 34 are connected in a circuit schematically illustrated in FIG. 13. Switch 98 is preferably a single pole two throw switch having a common terminal 126 alternately connectable to two contacts 128 and 130. FIG. 13 shows the switch in the "open" state with terminal 126 connected to contact 128 (solid line). The dotted line to terminal 130 indicates the switch configuration when in the "closed" state. Switch 98 is normally biased in the open state by a means for biasing the switch such as spring 125, and moved to the closed state by the action of floating cam 96 described above.

Motor 34 is a direct current motor having terminals 132 and 134. Motor terminal 132 is connected via a conductive path 133 to switch contact 128 and to a terminal 136 energized to an electrical potential by the power supply (batteries 26 or transformer). Motor contact 134 is connected by another conductive path 135 to common terminal 126. Switch contact 130 is connected by yet another conductive path 137 to a terminal 138 energized to an electrical potential different from terminal 136. Preferably the conductive paths are formed by wires.

When the stapler components are in the ready position, the switch is in the open state with common terminal 126 connected to contact 128. In this state current is interrupted to the motor and the motor terminals 132 and 134 are connected to each other in a closed loop. When floating cam 96 closes switch 98 causing terminal 126 to connect with contact 130, current flows through the motor creating torque on the shaft which operates the stapler. When cam surface 44*a* of cam wheel 44 falls off of the switch 98 (FIG. 7), the switch opens under its biasing means 125 (see FIG. 13), connecting terminal 126 back with contact 128, cutting off power to the motor and again connecting the motor terminals 132 and 134 in a closed loop. Connecting the motor terminals causes the transient magnetic fields in the motor to collapse much faster than if the terminals were not connected, thus, preventing these transient fields from providing significant additional torque to move the stapler components beyond the ready position.

Figure 7:
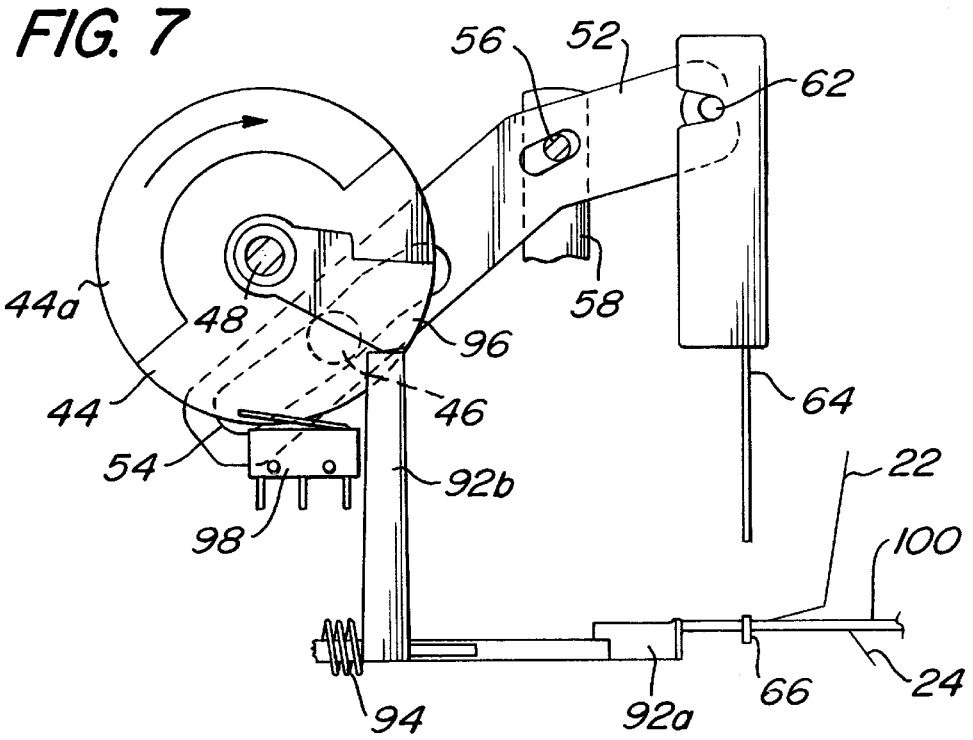
Figure 8:
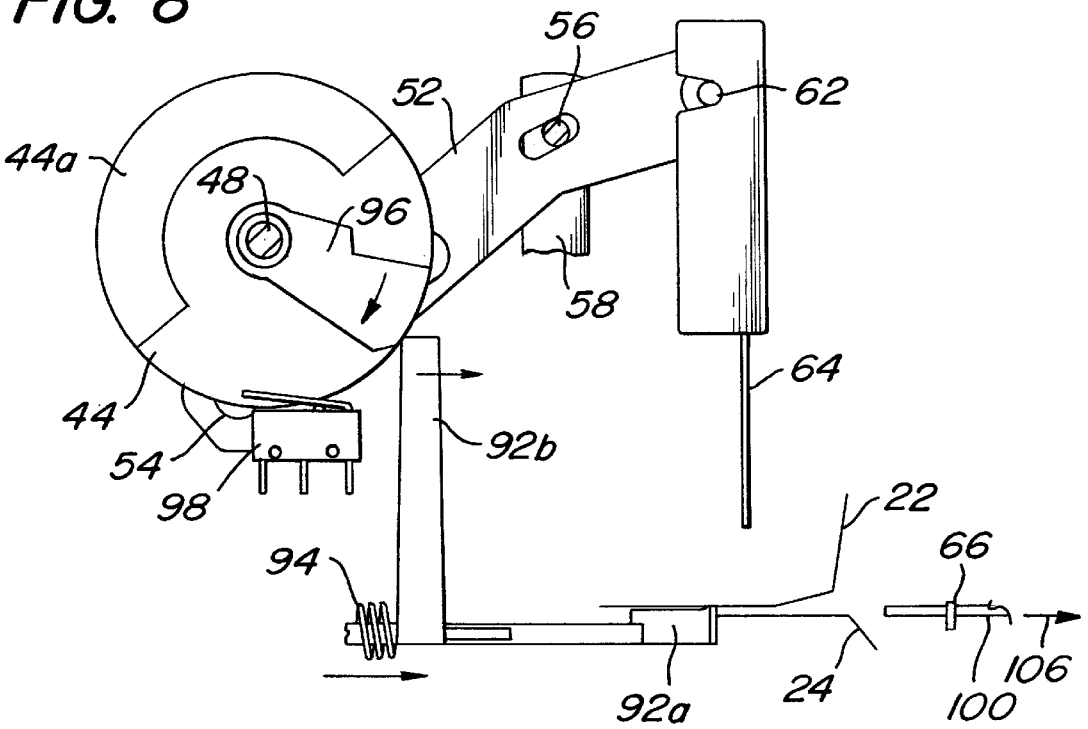

As seen in FIG. 7, floating cam 96, which has been pushed off of switch 98 by cam surface 44*a* rotates under the force of gravity and comes to rest on the tip of cam engaging end portion 92*a* of pusher 92. This occurs because the sheet material 100 is still engaged with the sheet material engaging portion 92*a* of the pusher. As seen in FIG. 8, once the sheet material 100 is removed from the stapler (indicated by arrow 106) the biasing spring 94 moves the pusher toward the anvil 90 allowing the floating cam to fall against the switch 98. The stapler is again in the "ready" position illustrated in FIG. 3.

Stapler Operation Preventing Jamming

A weakness of many electric staplers is in their inability to avoid jamming when overloaded with too many sheets or sheets of a heavier gauge than the staple can penetrate. The electric stapler according to the invention prevents jamming by use of the plunger and collar mechanism as best illustrated in FIGS. 9–12.

Figure 9:
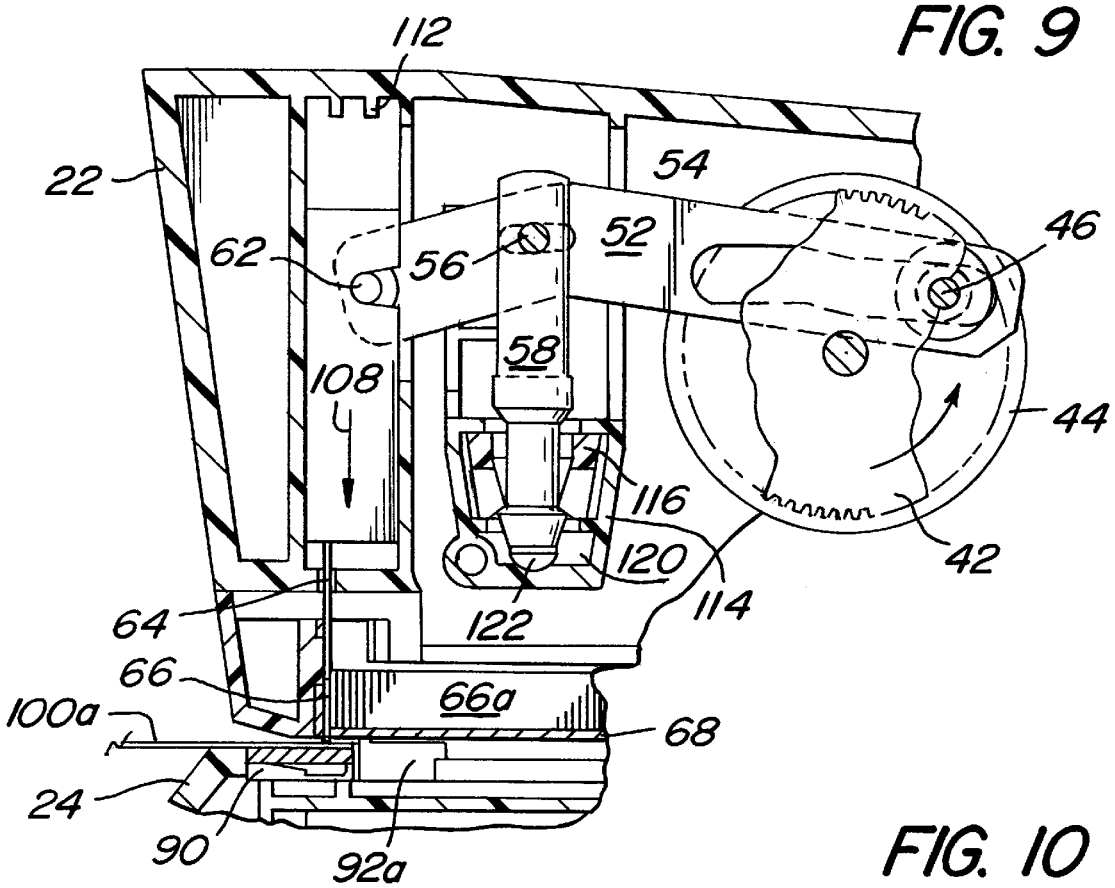
FIGS. 9 and 10 show a partial sectional side view on an enlarged scale from FIG. 1 showing components in different positions of operation.

FIG. 9 represents the stapler when sheet material 100*a*, which will jam the stapler, is inserted between magazine 68 and anvil 90, moving pusher 92 as described above to actuate the stapler. Crank arm 46 turns counterclockwise pivoting lever 52 about pin 56 forcing blade 64 in its forward stroke toward anvil 90 in a direction shown by arrow 108. Blade 64 engages staple 66, strips it from magazine 68 and attempts to force it through sheet 100*a*, but, for whatever reason, cannot. Any further motion of the blade toward the anvil is prevented by sheet 100*a*, but the motor continues to deliver torque turning crank arm 46 because cam surface 44*a* (FIG. 5) is still in contact with switch 98 holding it in its closed position. The crank, thus, continues trying to raise the slotted end of lever 52.

Figure 10:
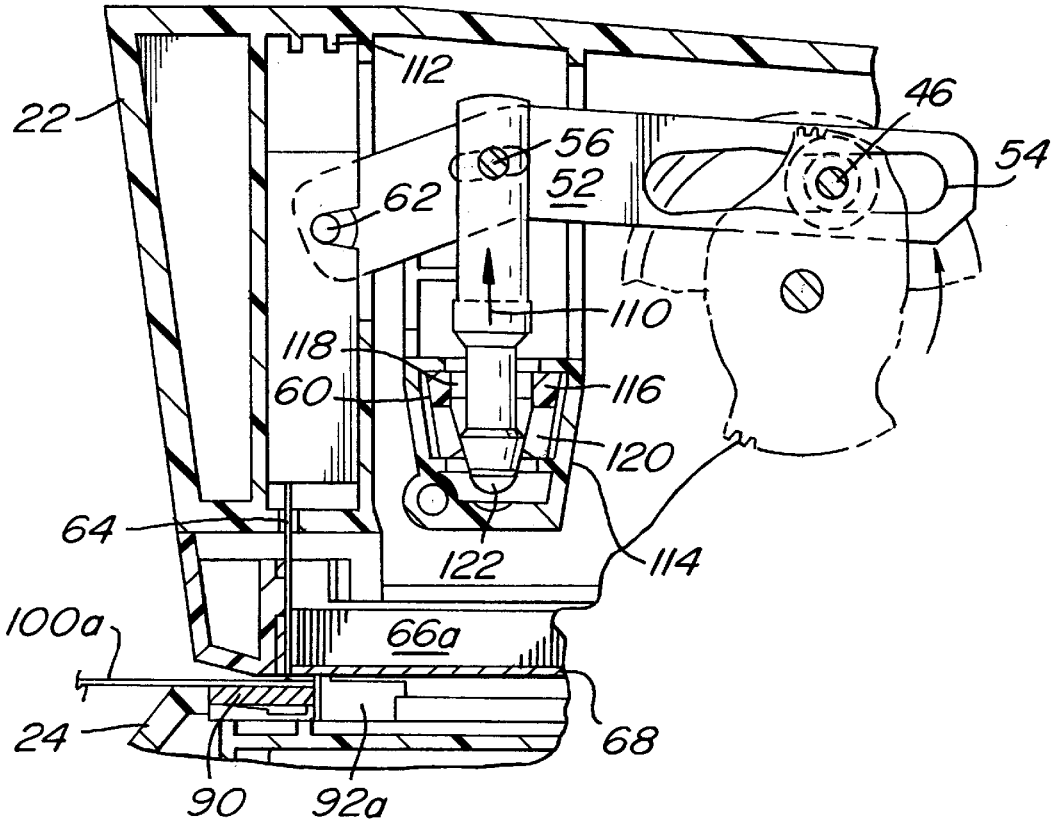

As shown in FIG. 10, this causes a force, represented by arrow 110, to be applied to plunger 58 in the direction of the arrow. The force results in response to forces between the blade and the sheet 100*a* which prevent movement of the blade through its forward stroke. When force 110 exceeds a predetermined maximum value (known as the "release force"), plunger 58 separates from collar 60 and moves away therefrom. The fulcrum of the lever shifts from pin 56 to pin 62 and the lever 52 pivots about the end attached to blade 64. The separation of the plunger from the collar allows the crank to continue turning, first moving the plunger away from the collar and then again toward it. When plunger 58 contacts the collar again, the pivot point of the lever shifts back to pin 56, and the blade 64 is moved away from the anvil 90 in its reverse stroke. Crank arm 46 continues turning, moving the blade 64 to its maximum reverse stroke position away from anvil 90, but because the plunger 58 is not fully engaged in collar 60 but only contacting it as illustrated in FIG. 10, the lever assembly is above its normal position relative to the housing. This causes the top of blade 64 to contact bearing points 112 on housing 22. The pivot point of the lever again changes from pin 56 to pin 62 and the lever applies a force on the plunger in the opposite direction to force 110. When this opposite force exceeds a second predetermined value (known as the "reengagement force"), plunger 58 is forced through collar 60 into its normal fully engaged position seen in FIG. 9. The plunger is reset for the next stapling operation, being retained to the collar in its normal position as described in detail below. Simultaneously with the plunger's repositioning in collar 60 the stapler is returned to the ready position of FIG. 3 and can be used immediately to staple sheets once sheet 100*a* is removed.

Figure 11:
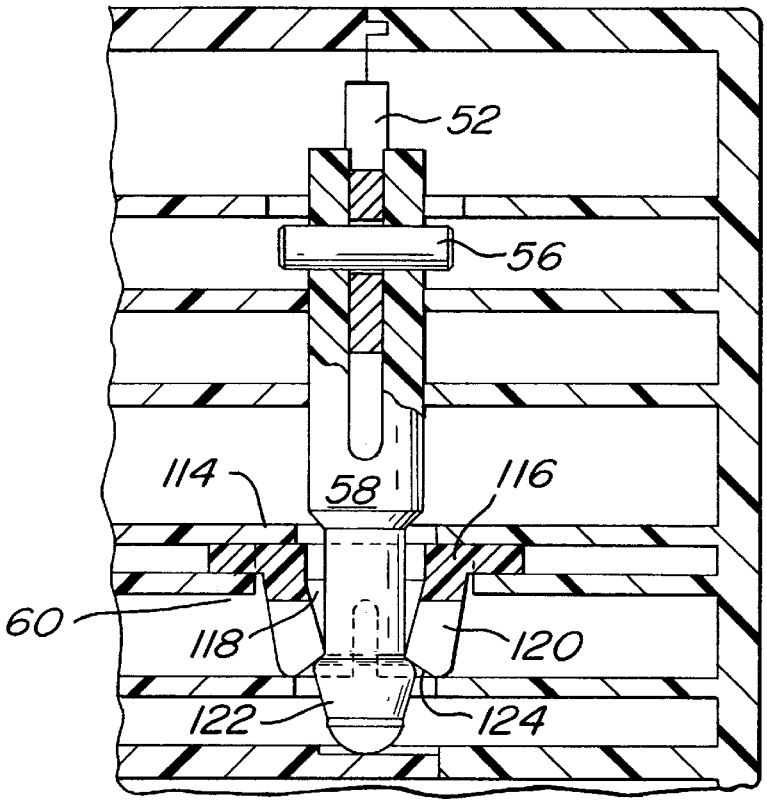
FIG. 11 shows a cross-sectional view on an enlarged scale taken along line 11—11 of FIG. 1.

As best seen in FIGS. 10 and 11, collar 60 is fixedly mounted within a cage 114 attached to housing 22. Cage 114 provides a fixed support for the plunger 58 allowing it to serve as a fulcrum during normal stapler operation. Preferably, the collar is made of nylon or another plastic material and comprises an annular portion 116 defining an aperture 118 through which plunger 58 passes to be properly positioned.

Figure 12:
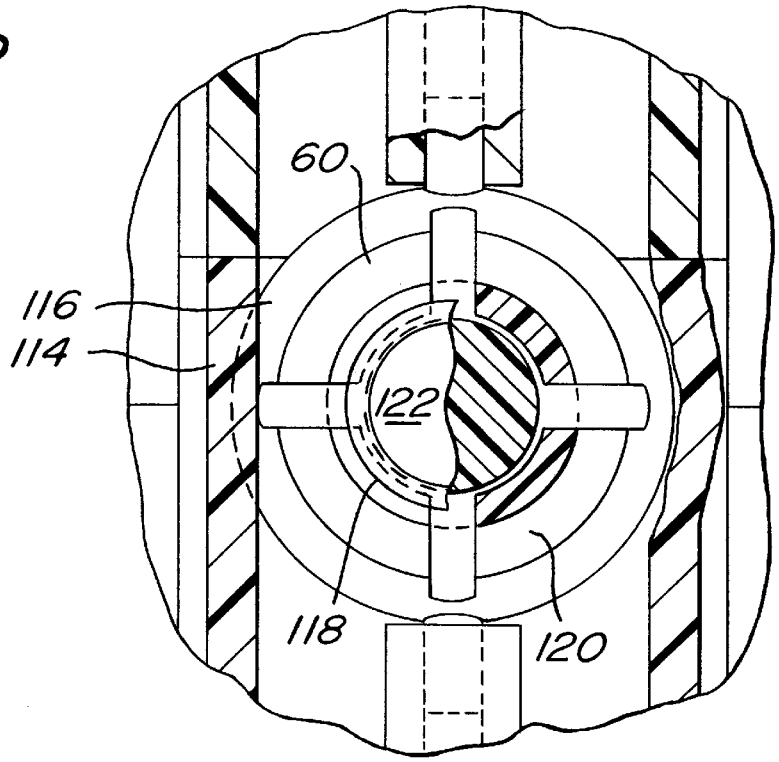
FIG. 12 shows a cross-sectional view on an enlarged scale taken along line 12—12 of FIG. 1.

As seen in FIGS. 11 and 12, a plurality of fingers 120 are positioned circumferentially around aperture 118. The fingers provide a means for releasably attaching the fulcrum to the support. Each of the fingers is oriented at an angle converging on a common center. The fingers and collar form a flexible retainer for maintaining plunger 58 engaged with the support cage 114.

Plunger 58 has an enlarged head 122 preferably having a conical shape and a sloping or rounded shoulder 124 at the base of the cone. The head is sized to fit through the aperture 118 in the annular portion 116 of the collar but is too large to pass through the fingers 120 without deflecting them. FIG. 11 illustrates the fully engaged position of plunger 58 with collar 60. The conical head 122 has passed through aperture 118 and elastically deflected the fingers 120 outwardly, the fingers flexibly snapping back to their undeflected position after head 112 clears them. Fingers 120 rest against the shoulder 124 of the plunger, retaining the plunger to the collar, and hence within cage 114, thus, allowing pin 56 to serve as a fulcrum for lever 52.

However, plunger 58 is only releasably retained by collar 60. The sloping or rounded shoulder 124 permits the fingers 120 to slide over the shoulder and separate to allow the plunger head 122 to pop out of interengagement with the collar if a force equal to or exceeding the release force is applied to the plunger.

One strategy for determining the desired release force is to set the value in proportion to the number of sheets the stapler is intended to staple in the course of normal operation. Thus, for example, the release force would be set relatively higher for a stapler intended to staple 20 sheets of 75 g/m$^2$ weight paper in comparison with a stapler intended to staple a maximum of 12 sheets of the same weight paper. It requires greater force to push a staple through 20 sheets, thus the plunger must be held against the higher reaction forces which will be encountered at the fulcrum when stapling more sheets, necessitating the higher release force for the plunger of the 20 sheet stapler. The lower the release force the smaller the number of sheets the stapler will handle before the plunger is released.

It is preferred however to have the same release force regardless of the number of sheets to be stapled, and to compensate for the difference in stapler capacity by controlling the mechanical advantage provided by lever 52 in conjunction with the size of motor 34. For example, a release force of approximately 52 lbs has been found practical for staplers intended for typical office use. For a 12 sheet stapler (75 g/m$^2$ weight paper), the lever 52 (see FIG. 1) is designed, by adjusting the ratio of the arm lengths about the fulcrum 56, to have a mechanical advantage of approximately 3.3. This means that the force applied by the crank arm 46 is multiplied by a factor of 3.3 when the crank arm is farthest from the fulcrum 56 in slot 54. Thus when the blade forward motion is prevented and lever 52 pivots about pin 62, crank arm 46 need only exert 52/3.3 or 15.76 lbs at the opposite end of the lever to effect the release of plunger 58.

For the 20 sheet stapler (75 g/m$^2$ weight paper) the lever is designed with a mechanical advantage of only 3.0. Thus to effect release of plunger 58 the crank arm 46 must exert 52/3 or 17.33 lbs. This requires a larger motor 34 than is used in the 12 sheet stapler, and results in greater force being applied by the blade before release of plunger 58 is effected, thus allowing more sheets to be stapled before the jammed condition is reached.

Setting stapler capacity by controlling the mechanical advantage of lever 52 provides several advantages in stapler design and manufacture. For instance, many of the same parts can be used in both the 12 sheet and 20 sheet staplers, resulting in lower production and procurement costs. Furthermore, the combination of lever and motor provides a precise means for controlling the required release force. It is relatively easy to specify motor size and lever geometry in comparison with the parameters which would be required to directly affect the force required to release the plunger from the collar as described below.

If desired, the plunger release force can be directly controlled by (among other parameters) the choice of the material for the collar 60, the length and cross sectional shape of the fingers 120, the shape or slope of the shoulder 124, the maximum diameter of the head 122 and the minimum diameter of the aperture 118 (at the tips of fingers 120). The effects of these parameters are discussed briefly below.

Collar material choice affects the force required to release the plunger through the material's modulus of elasticity. Inherently stiffer material characterized by relatively a high modulus of elasticity will result in a higher force being required to disengage the plunger, and conversely material having a lower modulus will lower the required force.

The fingers 120 are cantilevered from the annular portion 116 and must bend outwardly when they deflect to permit the head to pass. The bending stiffness of a cantilever beam is inversely proportional to its length. Using longer fingers 120, therefore, will reduce the bending stiffness of the fingers and thereby reduce the force required to disengage the plunger. Conversely shorter fingers will increase the force.

The bending stiffness of a cantilever beam is also directly proportional to the area moment of inertia of the beam cross section, thus, increasing the area moment of inertia by changing the fingers' cross sectional shape can increase the fingers' bending stiffness and thereby the force needed to disengage the plunger. Conversely, reducing the area moment of inertia will decrease the force required.

If the shoulder 124 has a gradual slope, it will require less force to disengage the plunger than if the slope is steep. A gradual slope will act like a wedge and more easily part the fingers. A steep slope will tend to jam against the fingers and require a larger force to disengage the plunger.

Lastly, larger head diameters will require larger deflections of the fingers to permit disengagement of the plunger. This will require larger forces be exerted on the fingers since the force is proportional to the deflection, resulting in an overall higher force being required to separate the plunger from the collar.

For a stapler intended for office use a reengagement force (the force to reengage the plunger with the collar) of approximately 20 lbs is preferred. A relatively low reengagement force is desirable so as not to overwork the motor or stress the components unnecessarily. The lower force required for reengagement (as compared with the release force) is made possible by the conical shape of the plunger head and the angular orientation of the fingers. The head acts as a wedge to move the fingers apart gradually and is much easier to push the head through the fingers than it is to pull it back out due mainly to the difference in the slope between the cone and the shoulder 124.

The stapler according to the invention provides for the convenience of a powered stapler without the drawbacks of jamming which often render such appliances frustrating to use. The floating pivot point anti-jamming mechanism is simple, dependable, implemented with few parts and inexpensive, and results in a stapler which will give excellent service over a long life.

What is claimed is:

1. A stapler using wire staples for stapling sheet material, said stapler comprising:

a magazine for holding the staples, said magazine having a dispensing opening to allow the staples to be stripped from said magazine one at a time;

a blade slidably mounted for reciprocal motion with respect to said magazine, said blade reciprocating through a forward and a reverse stroke and being interengagable on the forward stroke with a staple disposed at said dispensing opening for stripping said staple from said magazine;

an anvil positioned with respect to said dispensing opening to clinch a staple stripped from said magazine and forced thereagainst by said blade during the forward stroke;

an elongated lever, said blade being pivotally attached to said lever at a first attachment point;

a first fulcrum for said lever, said first fulcrum being pivotally attached to said lever at a second attachment point spaced from the first attachment point;

an actuator for imparting rocking motion to said lever, said actuator being pivotally attached to said lever at a third attachment point displaced from the first and second attachment points;

a first support for said first fulcrum, said first fulcrum translating the rocking motion of said lever to reciprocal motion of said blade when said first fulcrum is positioned on said first support, said lever being free to pivot about said first attachment point when said first fulcrum is separated from said support;

a flexible retainer for maintaining said first fulcrum on said first support, said retainer being yieldable to allow separation of said first fulcrum from said first support in response to forces preventing blade movement through said forward stroke; and a second support interengagable with said blade at said first attachment point for preventing liner movement through a reverse stroke when said first fulcrum is separated from said first support, said first attachment point thereby forming a second fulcrum for said lever, said actuator pivoting said lever about said second fulcrum to again engage said first fulcrum with said first support after said first fulcrum is separated therefrom.

2. A stapler according to claim 1, wherein said second attachment point is located between said first and said third attachment points.

3. A stapler according to claim 1, wherein said actuator comprises:

an elongated slot formed in said lever lengthwise thereof at said third attachment point;

a crank being rotatably mounted with respect to said lever, said crank having an eccentric arm extending therefrom and interengaging said slot for pivoting said lever about said first fulcrum upon rotation of said crank;

an electric motor for rotating said crank and thereby imparting said rocking motion to said lever and reciprocating said blade; and a switch assembly for controlling said actuator.

4. A stapler according to claim 3, further including a battery receptacle for support of an electric battery for powering said electric motor.

5. A stapler according to claim 3, wherein said switch assembly comprises:

a switch for supplying electrical power to said motor when said switch is in a closed state, said switch normally being in an open state;

a first cam rotatably mounted with respect to and interengagable with said switch and being moveable to a position in which the switch is closed;

a movable pusher interengagable with sheet material and disposed between said anvil and said magazine, said pusher further having an end portion interengagable with said first cam and means for biasing said end portion away from said first cam, said pusher rotating said first cam into the position in which the switch is closed upon interengagement with the sheet material;

a second cam rotatably mounted with respect to said switch, said second cam being rotated by said electric motor upon closure of the switch and interengagable with said switch upon rotation thereof to maintain said switch in said closed position, said second cam being interengagable with said first cam to rotate said first cam out of interengagement with said switch and reposition said first cam adjacent to said pusher end portion.

6. A stapler according to claim 5, wherein said second cam is mounted coaxially with said crank for rotation therewith about a common axis, said second cam being disposed diametrically opposite to said arm relative to said common axis, said second cam having a curved cam surface for engaging said switch, said cam surface subtending an angle of approximately 180 degrees.

7. A stapler according to claim 5 further comprising:

first and second motor terminals disposed on said electric motor;

a common terminal and first and second contacts disposed on said switch, said common terminal being alternately connectable to each said contacts, said switch being in said closed state when said common terminal is connected to said second contact, said switch being in said open state when said common terminal is connected to said first contact;

first and second power terminals energizable at different electrical potentials;

a first conductive path connecting said first motor terminal to said first power terminal and said first contact;

a second conductive path connecting said second motor terminal to said common terminal;

a third conductive path connecting said second contact to said second power terminal; and said motor being powered when said common terminal is connected to said second contact, said first motor terminal being connected to said second motor terminal when said common terminal is connected to said first contact.

8. A stapler according to claim 7, further comprising means for biasing said common terminal into contact with said first contact, said common terminal being normally biased into contact thereto.

9. A stapler according to claim 1, wherein:

said first fulcrum comprises an elongated plunger having first and second ends, said first end being pivotally connected to said lever, said second end having an enlarged head mounted thereon; and said flexible retainer comprises a plurality of fingers mounted on said first support, said fingers being positioned about a common center to accept said plunger in mating interengagement, said fingers interengaging said plunger behind said enlarged head when said plunger is in mating interengagement therewith to retain said plunger to said first support, said fingers being relatively flexible and bending to pass over said enlarged head to allow separation of said plunger from said first support in response to said forces preventing blade movement through said forward stroke.

10. An electric stapler using wire staples to attach multiple layers of sheet material together up to a maximum number of layers which a staple can penetrate, said electric stapler comprising:

a magazine for holding the staples, said magazine having a slot therein to allow the staples to be stripped from said magazine one at a time;

a blade slidably mounted for reciprocal motion relatively to said magazine and oriented above said slot, said blade being interengagable with said slot for stripping the staples from said magazine during reciprocal motion thereof;

an anvil mounted beneath said slot, said anvil clinching the staples stripped from said magazine and forced thereagainst by said blade;

an elongated lever, said blade being pivotally attached to said lever at a first attachment point;

a fulcrum for said lever, said fulcrum being pivotally attached to said lever at a second attachment point spaced from said first attachment point;

means for rocking said lever about said fulcrum and thereby reciprocating said blade, said lever rocking means being attached to said lever at a third attachment point displaced from said first and second attachment points;

a fixed support for said fulcrum, said fulcrum translating the rocking motion of said lever to reciprocal motion of said blade when said fulcrum is positioned on said fixed support, said lever being free to pivot about said first attachment point when said fulcrum is separated from said support;

means for releasably attaching said fulcrum to said support;

means interengagable with the sheet material for actuating said lever rocking means, said actuating means being disposed between said magazine and said anvil; and said sheet material being positioned between said anvil and said magazine and engaging said actuating means thereby causing said lever rocking means to rock said lever about said fulcrum and reciprocate said blade, said blade stripping one of the staples from said magazine and forcing it through said slot and against said sheet material, the staple normally penetrating the sheet material up to the maximum number of layers and being clinched against said anvil, said releasable attaching means releasing said fulcrum from said fixed support when said sheet material exceeds the maximum number of layers which the staple can penetrate, said lever rocking means then pivoting said lever about said first attachment point to reattach said fulcrum to said fixed support.

11. A stapler according to claim 10, wherein said second attachment point is positioned between said first and third attachment points.

12. A stapler according to claim 10, wherein said releasable attaching means releases said fulcrum from said fixed support when said sheet material comprises more than 12 sheets of paper of 75 $g/m^2$ weight.

13. A stapler according to claim 10, wherein said releasable attaching means releases said fulcrum from said fixed support when said sheet material comprises more than 20 sheets of paper of 75 $g/m^2$ weight.

14. A stapler according to claim 10, wherein:

said fulcrum comprises a plunger disposed spaced apart from said blade, said plunger having a first end pivotally attached to said lever, and a second end having an enlarged head distally mounted thereon; and said releasable attaching means comprises a release collar fixedly mounted on said fixed support and having an aperture sized to accept said enlarged head in mating interengagement therethrough, said releasable attaching means further comprising a plurality of fingers positioned circumferentially around said enlarged head, each of said fingers being oriented at an angle converging on a common center, said fingers interengaging said plunger behind said enlarged head when said plunger is in mating interengagement with said release collar, said fingers retaining said plunger within said release collar and thereby allowing said plunger to form said fulcrum when the sheet material being stapled has less than the maximum number of layers which the staple can penetrate, said fingers being relatively flexible and separating outwardly away from said aperture to pass over said enlarged head and release said plunger when the sheet material being attached exceeds the maximum number of layers which the staple can penetrate.

15. A stapler according to claim 10, wherein said lever rocking means comprises:

an elongated slot formed in said lever lengthwise thereof at said third attachment point;

a crank rotatably mounted, said crank having an eccentric arm extending therefrom and interengaging said slot for rocking said lever about said fulcrum upon rotation of said crank; and an electric motor for rotating said crank.

16. A stapler according to claim 15, further including a jack sized to accept a plug from a transformer interengagable with a standard 110 v AC electrical outlet to power said motor.

17. A stapler according to claim 15, wherein said actuating means comprises:

a switch for supplying electrical power to said motor when said switch is in a closed state, said switch normally being in an open state;

a first cam rotatably mounted with respect to and interengagable with said switch, said cam closing said switch upon rotation of said cam into a position of interengagement with said switch;

a pusher disposed between said anvil and said magazine and movably mounted with respect to said magazine, said pusher being interengagable with the sheet material and having an end portion interengagable with said first cam, said pusher having means for biasing said end portion away from said first cam, said pusher rotating said first cam into the position in which the switch is closed upon engagement with the sheet material;

a second cam rotatably mounted with respect to said switch, said second cam being rotated by said electric motor into interengagement with said switch upon closure of said switch to maintain said switch in said closed position, said second cam also being interengagable with said first cam to rotate said first cam out of interengagement with said switch and reposition said first cam adjacent to said pusher end portion.

18. A stapler according to claim 17, further comprising a common axle for rotatably mounting said crank and said first and second cams.

19. A floating pivot point mechanism, comprising:

an elongated lever;

a driven member movably mounted for reciprocal motion, said driven member being pivotally attached to said lever at a first attachment point;

a first support fixed relatively to said lever;

a fulcrum releasably mounted on said first support and pivotally attached to said lever at a second attachment point spaced from the first point;

a driving assembly for pivoting said lever about said fulcrum and thereby driving said driven member in reciprocal motion, said driving assembly being pivotally attached to said lever at a third attachment point spaced from the first and second points;

a flexible retainer for maintaining said fulcrum on said first support, said retainer being yieldable to allow separation of said fulcrum from said first support in response to forces preventing movement of said driven member through a forward stroke; and a second support fixed relatively to said lever, said second support being positioned to engage said driven member at said first attachment point and to prevent movement of said lever through a reverse stroke when said fulcrum is separated from said first support, said lever being pivoted about said first attachment point by said driving assembly and thereby moving said fulcrum into interengagement with said flexible retainer, said flexible retainer thereafter maintaining said fulcrum releasably on said first support.

20. A mechanism according to claim 19, wherein said second attachment point is disposed between said first and said third attachment points.

21. A mechanism according to claim 19, wherein:

said fulcrum comprises an elongated plunger having first and second ends, said first end being pivotally connected to said lever, said second end having an enlarged head mounted thereon; and said flexible retainer comprises a plurality of fingers mounted on said first support, said fingers being positioned about a common center to accept said plunger in mating interengagement, said fingers interengaging said plunger behind said enlarged head when said plunger is in mating interengagement therewith to retain said fulcrum to said first support, said fingers being relatively flexible and bending to pass over said enlarged head to allow separation of said fulcrum from said first support in response to said forces preventing driven member movement.

* * * * *